US012304594B2

(12) United States Patent
Cao

(10) Patent No.: US 12,304,594 B2
(45) Date of Patent: May 20, 2025

(54) MANUALLY OPERATED RETRACTABLE SHADE SYSTEM

(71) Applicant: John Cao, Boca Raton, FL (US)

(72) Inventor: John Cao, Boca Raton, FL (US)

( * ) Notice: Subject to any disclaimer, the term of this patent is extended or adjusted under 35 U.S.C. 154(b) by 649 days.

(21) Appl. No.: 17/588,225

(22) Filed: Jan. 29, 2022

(65) Prior Publication Data

US 2022/0266954 A1 Aug. 25, 2022

Related U.S. Application Data

(63) Continuation-in-part of application No. 17/185,169, filed on Feb. 25, 2021, now Pat. No. 11,851,137.

(51) Int. Cl.
*B63B 17/02* (2006.01)
*E04H 15/44* (2006.01)

(52) U.S. Cl.
CPC ..... *B63B 17/02* (2013.01); *E04H 15/44* (2013.01)

(58) Field of Classification Search
CPC ..... B63B 17/02; E04H 15/44
See application file for complete search history.

(56) References Cited

U.S. PATENT DOCUMENTS 5,579,797 A * 12/1996 Rogers ..... A45B 23/00 135/96
6,039,061 A * 3/2000 Utley ..... A45B 1/00 114/361
2017/0349241 A1* 12/2017 Cao ..... B63B 17/02

* cited by examiner

*Primary Examiner* — Stephen P Avila

(57) ABSTRACT

A retractable shade system for attachment to a boat structure is disclosed. The retractable shaded system can include a housing removeable attachable to the existing boat structure. A pair of telescoping swing arms are pivotally connected at opposite ends of the housing, where the pair of swing arms are moveable between a folded and unfolded position. A retractable cover connected to the housing and movable between a furled position and an unfurled position. When the in the furled position, the retractable cover is positioned in the housing adjacent to the pair of telescoping swing arms, and in the unfurled position the retractable cover extends between and along the length of the unfolded pair of telescoping swing arms. The retractable cover is connected to ends of the parallelly unfolded pair of telescoping swing arms to form the shade/awning.

13 Claims, 27 Drawing Sheets

MANUALLY OPERATED RETRACTABLE SHADE SYSTEM

CROSS REFERENCE TO RELATED APPLICATION

This patent application is a Continuation-in-Part (CIP) of U.S. patent application Ser. No. 17/185,169 entitled MANUALLY OPERATED RETRACTABLE SHADE SYSTEM, filed on Feb. 25, 2021, the content of which is herein incorporated by reference in its entirety.

FIELD OF THE INVENTION

The present invention relates to tops and awnings for boats, and more particularly, to a manually extendable and retractable awning that mounts to an overhead structure on a boat.

BACKGROUND OF THE INVENTION

Smaller recreational boats can have fixed coverings erected upon the deck of the boat. These coverings can take the form of "T-tops" or "Bimini" tops. The typical T-top or Bimini top has a rigid tubular structure mounted to the deck or gunnels of the boat, being covered with a fabric or ridged cover.

A limitation of these tops are they only cover a small portion of the boat, typically the central cockpit area. This can leave a larger portion of the bow and stern of boat, and associated passengers, subject to strong sun rays.

In order to overcome this limitation, secondary covering have been developed which can be affixed to existing top structures. These secondary coverings allow for an extension of the covered area of the boat deck. However, many of these secondary coverings can be cumbersome, having complex structures and requiring a permanent mounting to the existing top structure. Some also require the use of electric motors, which necessitate the need for additional electrical wiring.

In an exemplary prior art, U.S. Pat. No. 9,862,461 discloses an awning for a boat that is operable between retracted and extended positions and includes a frame structure having left and right telescopically extendable and retractable tube assemblies each having a fixed tube, a telescopic mid tube and a telescopic end tube. Cross tubes extend transversely between each of the mid tubes and the end tubes. A canvas roller is mounted transversely between the fixed tubes. A sheet of marine canvas is secured to the roller and the end cross tube and is rolled onto the roller when the awning is retracted. A gear box disengages the canvas roller to allow the telescoping tube assemblies and canvas to be manually extended. To retract the awning, the gear box is engaged with the canvas roller and a removable crank handle is operated to rotate the roller and roll up the canvas as the frame structure is telescopically retracted. The content of U.S. Pat. No. 9,862,461 is herein incorporated by reference in its entirety.

In contrast, the present invention is directed to a portable manual covering which can be easily attached to and removed from existing top structures.

SUMMARY OF THE INVENTION

The present invention provides retractable shade system for attachment to an existing boat structure for providing shade to at least a portion of the deck of a boat. The retractable shade system can include a housing with a pair of telescoping swing arms pivotally connected at opposite ends therein. The pair of swing arms are moveable between a folded and unfolded position. The retractable shade system further has a retractable cover with a first end connected to the housing and a second end movable between a furled and an unfurled position.

In the retractable shade system, each of the pair of telescoping swing arms has an outer tube portion and a nested tube portion, wherein the outer tube portion is pivotally connected to the housing and the nested tube portion is slidingly positioned within the outer tube portion. In this manner, the telescoping swing arms are pivotable between a folded and unfolded position. In the folded position, the nested tube portions of the sliding telescoping swing arms are positioned within the outer tube portions, and the pair of telescoping swing arms are rotated into, and adjacently positioned within the housing. To place the pair of telescoping swing arms in the unfolded position, the pair of telescoping swing arms are rotated to a substantially perpendicular position with respect to the housing, and the nested tube portions are extended from the outer tube portions.

With regards to the retractable cover, when the cover is in the furled position, the retractable cover is positioned in the housing, adjacent to the pair of telescoping swing arms, for storage. When the retractable cover is in the unfurled position, the retractable cover extends between and along the length of the unfolded pair of telescoping swing arms. The retractable cover is connected to ends of the extended nested tube portions of the unfolded pair of telescoping swing arms to form the shade/awning.

To add structure, the retractable cover can have a cross member connected to an end of the retractable cover, opposite the housing. Using the cross member, when retractable cover is in the furled position, the retractable cover is rolled up about the cross member. When the retractable cover is in the unfurled position, the retractable cover is un-rolled from the cross member, extending between and along the length of the unfolded pair of telescoping swing arms. The opposite ends of the cross member are connected to ends of the extended nested tube portions of the unfolded pair of telescoping swing arms to form the shade/awning. The combination of the housing, unfolded telescoping swing arms and cross member form a support structure to support the canvas.

The retractable shade system is removeable attachable to different structures on a boat. For example, the retractable shade system can be attached to an existing boat top structure or a gunnel of a boat. In this manner, the retractable shade system can used to provide shade to different areas on the deck of a boat.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

The present invention provides retractable shade system for attachment to an existing to a boat to provide shade to at least a portion of the deck of a boat. The retractable shade system is removeable attachable to different structures on the boat. For example, the retractable shade system can be attached to an existing boat top structure or a gunnel of the boat. In this manner, the retractable shade system can provide shade to different portions of the deck of the boat.

Figure 1:
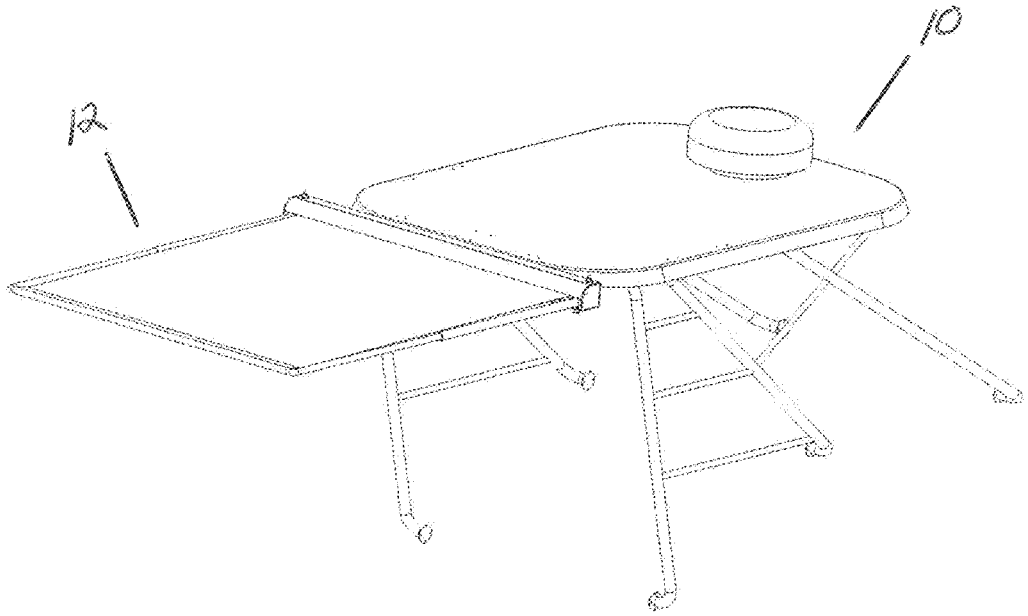
FIG. 1 depicts a retractable shade system of the present invention mounted on a boat top support structure.
Figure 2:
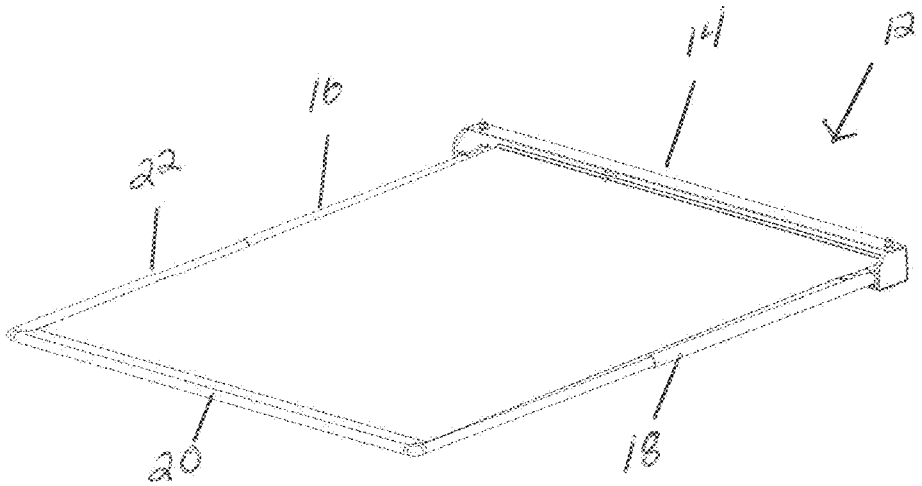
FIG. 2 depicts a perspective view of the retractable shade system of the present invention.

Referring now to the drawing figures in which like reference designators refer to like elements, there is shown in FIGS. 1 and 2 a retractable shade system 12 of the present invention. The retractable shade system 12 can be selectively/removable attached to an existing boat top structure 10. The retractable shade system 12 can include a base housing 14 with a pair of pivotal telescoping swing arms 16,18, where the base housing 14 is mountable to the boat top structure 10. A canvas cover 22 is connected at opposite ends to the housing 14 and a cross member 20. In the expanded position of the retractable shade system 12, the cross member 20 connects to the ends of the telescoping swing arms 16, 18, forming a support structure for the canvas cover 22.

Figure 3:
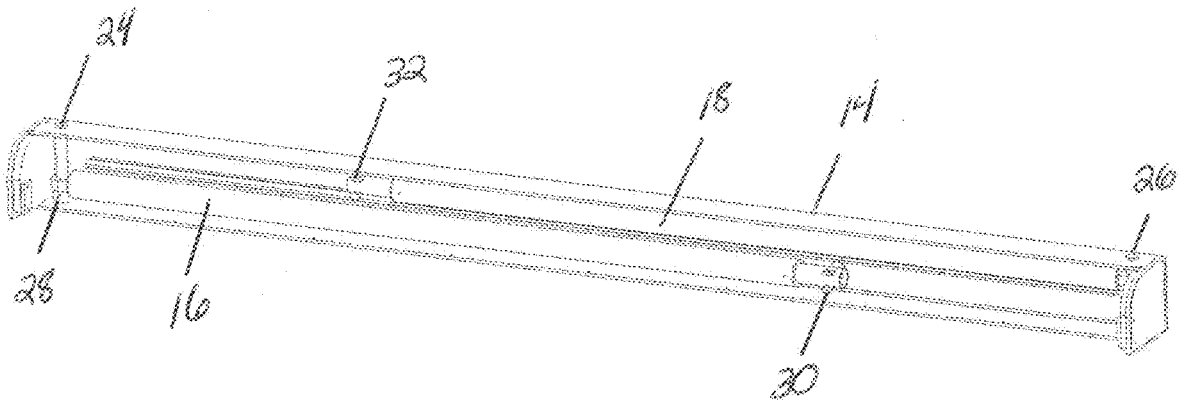
FIG. 3 depicts a partial perspective view of the folded swing arms of the retractable shade system of FIG. 1.
Figure 4:
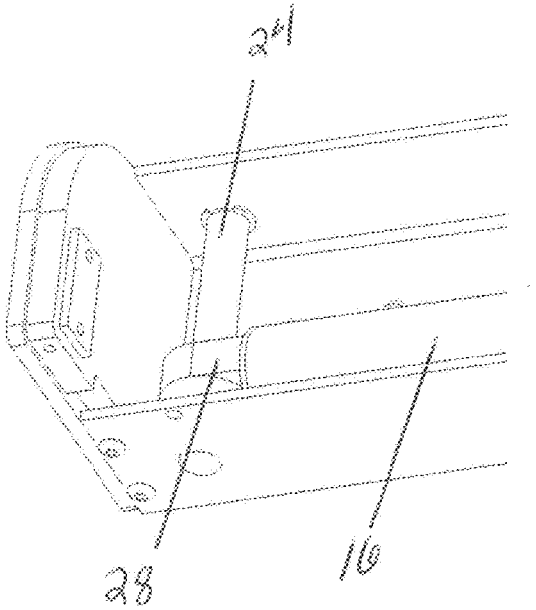
FIG. 4 depicts a partial sectional view the pivoting elements of the swing arms of the retractable shade system of FIG. 1.

Referring to FIGS. 3 and 4, the telescoping swing arms 16, 18 are each connected to a pivot pin 24, 26, positioned at opposite ends of the housing 14. The telescoping swing arms 16, 18 each include an eye bracket 28 connected to an end thereof, where the eye brackets 28 are positioned about the respective pivot pins 24, 26. The configuration of the eye brackets 28 permits the telescoping swing arms 16, 18 to be rotated about their respective pivot pins 24, 26, and well as being vertically slidable along the length of the pivot pins 24, 26.

In a retracted position of the retractable shade system 12, telescoping swing arm 16 is positioned at a lower end of the pivot pin 24, and folded, rotated, into the housing 14. The telescoping swing arm 16 is held in position within the housing 14 with a locking clip 30. Telescoping swing arm 18 is positioned at an upper end of the pivot pin 26, and folded, rotated, into the housing 14. The telescoping swing arm 18 is held in position within the housing 14 with a locking clip 32. In this configuration, are parallelly, adjacently positioned within the housing 14, where the telescoping swing arm 18 is positioned above telescoping swing arm 16.

Figure 5:
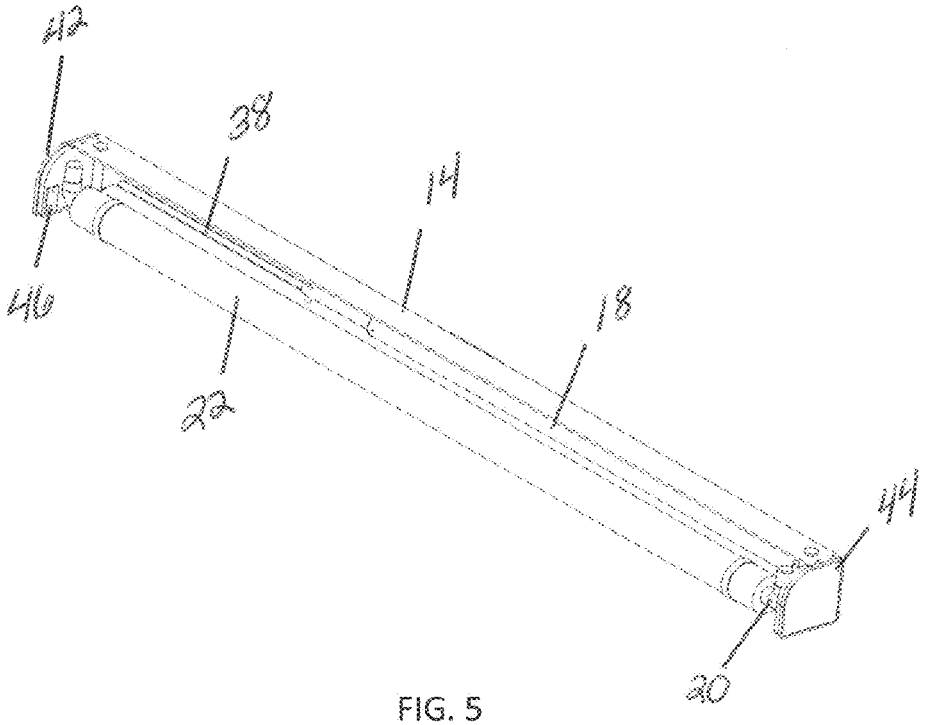
FIG. 5 depicts a perspective view of the stowed, furled, cover of the retractable shade system of FIG. 1.
Figure 6:
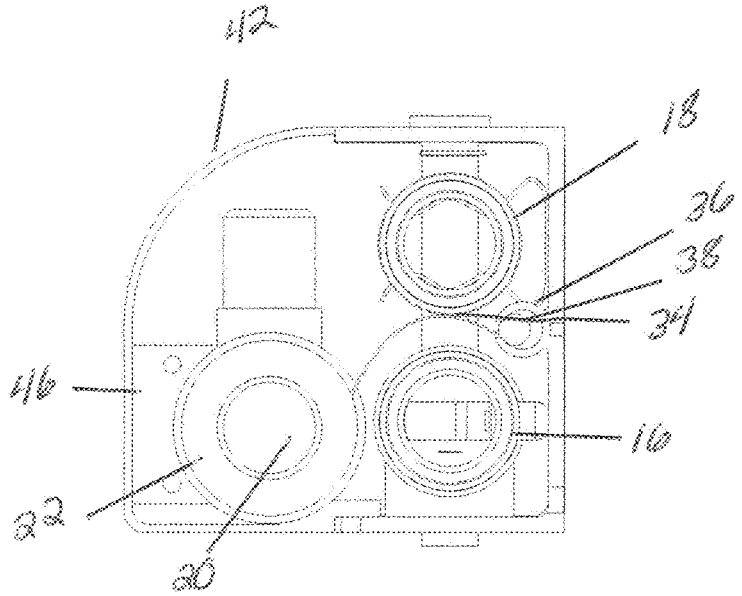
FIG. 6 depicts a side sectional view of the stowed, furled, cover of the retractable shade system of FIG. 1.

Referring to FIGS. 5 and 6, a first end 34 of the canvas 22 is connected to the housing 14 with an attachment flex rail 36. The attachment flex rail 36 can be separately attached or an integrated component of the housing 14. The first end 36 of the canvas 22 can include a fabric spline 38, which is slid into, and along the length of the attachment flex rail 36, securing the first end 34 of the canvas 22 to the housing 14. The second, opposite, end 40 of the canvas 22 is attached to the cross member 20. To store the canvas 22, the canvas 22 is furled about the cross member 20, and positioned in the housing 14, adjacent to the folded telescoping swing arms 16, 18.

Figure 7:
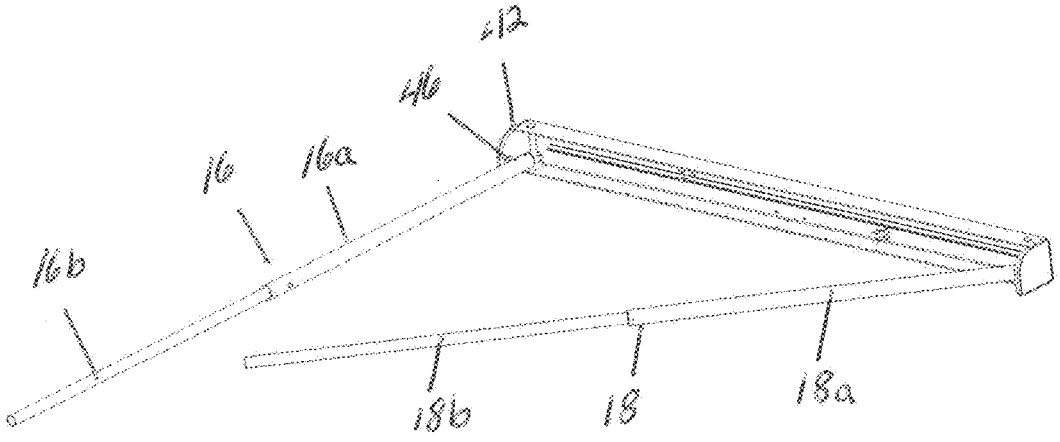
FIG. 7 depicts a partial perspective view of the unfolded of swing arms of the retractable shade system of FIG. 1.
Figure 8:
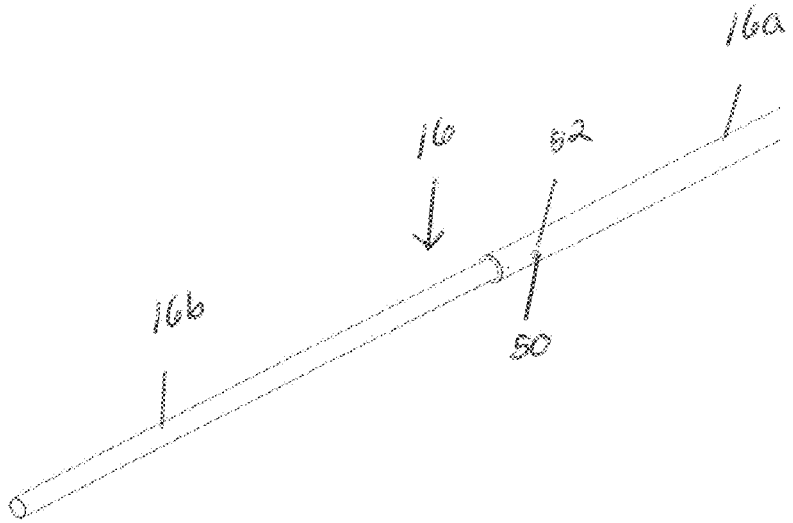
FIG. 8 depicts a partial perspective view of an extended swing arm of the retractable shade system of FIG. 1.

Referring to FIGS. 7 and 8, to expand the retractable shade system 12, the stored cross member 20 and canvas 22 are removed from the housing 14. The telescoping swing arms 16, 18 are each unfolded, rotated, about their respective pivot pins 24, 26, to a substantially parallel position with respect to each other, and substantially perpendicular to the housing 14. Each end cap 42, 44 of the housing 14 can include a swing arm stop 46, 48 (not shown) to which the telescoping swing arms 16, 18 are rotated against. The swing arm stops 46, 48 can be made of an elastic material.

Telescoping swing arm 16 has a nested tube 16*b* slidingly positioned with an outer tube 16*a*. Telescoping swing arm 16 is extended by sliding the nested tube 16*b* out from the outed tube 16*a*. When fully extended, a spring-loaded detent pin 50 on the nested tube 16*b* is positioned through a locking hole 52 in the outer tube 16*a*. This locks the position of the nested tube 16*b* with respect to the outer tube 16*a*. Similarly, telescoping swing arm 18 has a nested tube 18*b* slidingly positioned with an outer tube 18*a*. Telescoping swing arm 18 can be extended by sliding the nested tube 18*b* out from the outer tube 18*a*. When fully extended, a spring-loaded detent pin 54 on the nested tube 18*b* is positioned through a locking hole 56 in the outer tube 18*a*. This locks the position of the nested tube 18*b* with respect to the outer tube 18*a*.

Figure 9:
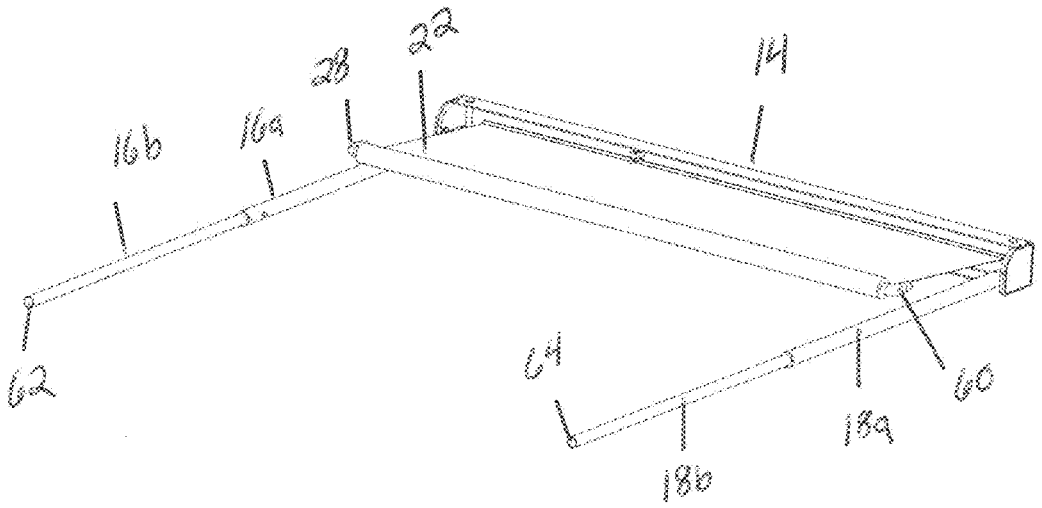
FIG. 9 depicts a perspective view of the partial unfurling of the cover of the retractable shade system of FIG. 1.
Figure 10:
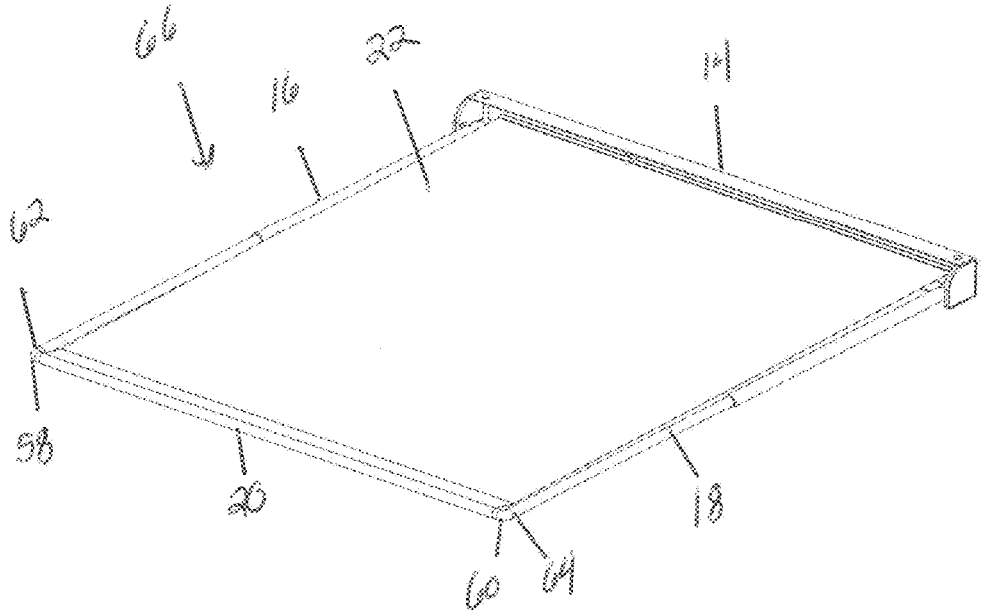
FIG. 10 depicts a perspective view of the unfurled cover of the retractable shade system of FIG. 1.

Referring to FIGS. 9 and 10, when both telescoping swing arms 16, 18 are locked in their extended positions, the canvas 22 is unfurled from the cross member 20. The cross-member elbows 58, 60 are positioned within the open ends 62, 64 of the respective telescoping swing arms 16, 18, forming a support structure 66 to support canvas 22. To maintain tension on the canvas 22, the canvas 22 can be made in-whole or in-part of an elastic material. The canvas 22 is sized slightly shorter than the length of the extended telescoping swing arms 16, 18, thus requiring that the canvas 22 be stretched to position the cross-member elbows 58, 60 within the open ends 62, 64 of the respective telescoping swing arms 16, 18. In this manner, a tension is maintained on the canvas 22. This also serves to hold the cross-member elbows 58, 60 within the open ends 62, 64.

To retract the retractable shade system 12, cross-member 20 is separated from the telescoping swing arms 16, 18 by removing the cross-member elbows 58, 60 from the open ends 62, 64 of the telescoping swing arms 16,18. Each on the telescoping swing arms 16, 18 is retracted by depressing the spring-loaded pins 50, 54, and sliding the nested tubes 16*b*, 18*b*, into the outer tubes 16*a*, 18*a*. Telescoping swing arms 16 is positioned at a lower end of the pivot pin 24, and rotated into the housing 14. The telescoping swing arm 16 is held in position within the housing 14 with a locking clip 30. Telescoping swing arm 18 is positioned at an upper end of the pivot pin 26, and rotated into the housing 14. The telescoping swing arm 18 is held in position within the housing 14 with a locking clip 32. The canvas 22 is furled about the cross member 20, and positioned in the housing 14, adjacent to the folded telescoping swing arms 16,18.

Figure 11:
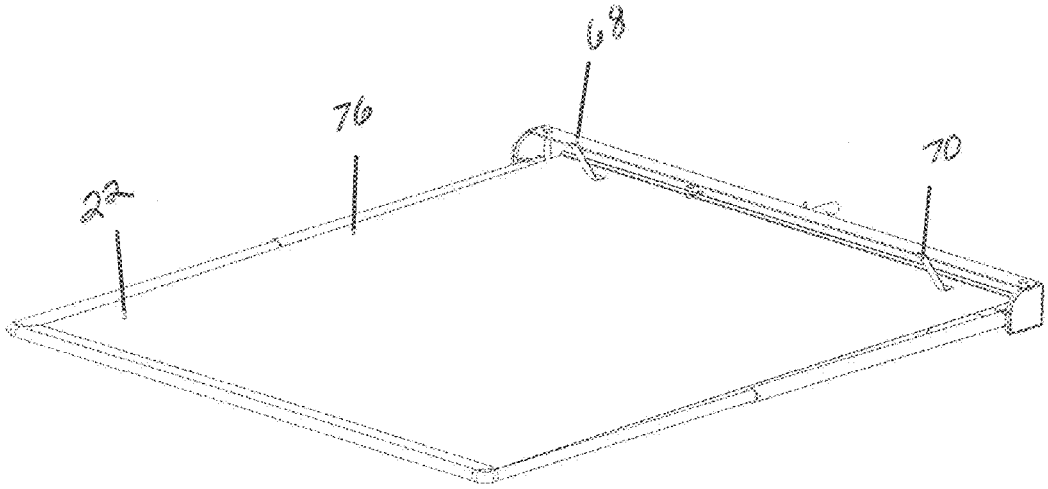
FIG. 11 depicts a perspective view of the hook and loop fastener strips on a top surface of the cover of the retractable shade system of FIG. 1.
Figure 12:
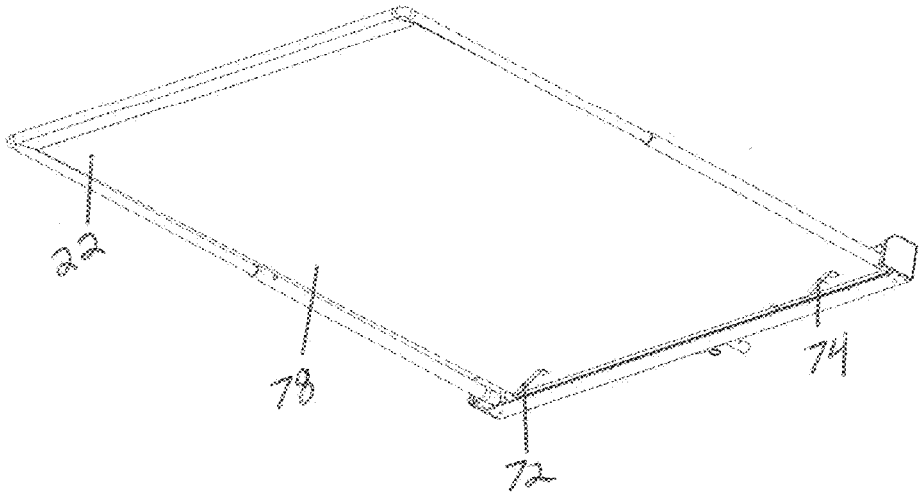
FIG. 12 depicts a perspective view of the hook and loop fastener strips on a bottom surface of the cover of the retractable shade system of FIG. 1.
Figure 13:
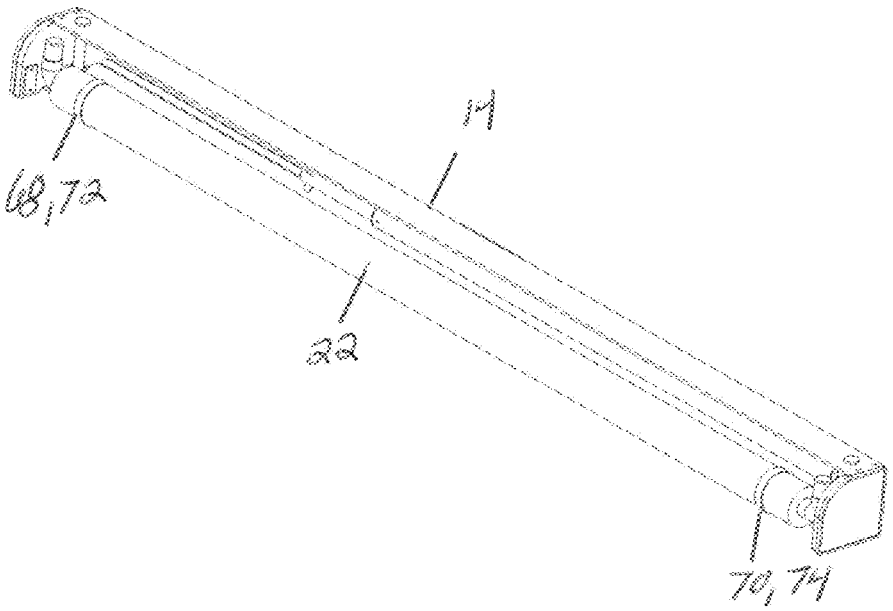
FIG. 13 a perspective view of the stowed, furled, cover secured with the hook and loop type fastening strips of the retractable shade system of FIG. 1.

Referring to FIGS. 11-13, to secure the canvas 22 in the furled position, hook and loop type securing strips 68, 70, 72, 74 are positioned on the top 76 and bottom 78 surfaces of the canvas 22. When canvas 22 is furled, the top and bottom hook and loop strips 68, 72 and 70, 74 are wrap together to secure the furled canvas 22.

Figure 14:
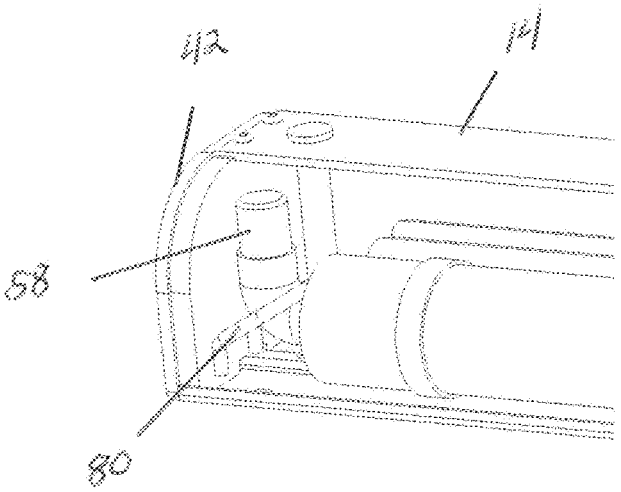
FIG. 14 depicts a partial sectional view of an elastic securing cord at a first end of the housing of the retractable shade system of FIG. 1.
Figure 15:
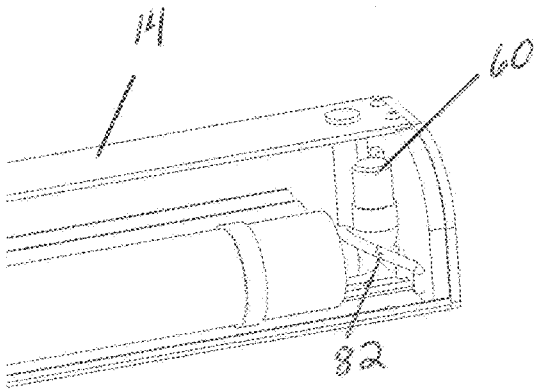
FIG. 15 depicts a partial sectional view of an elastic securing cord at a second end of the housing of the retractable shade system of FIG. 1.

In an embodiment, the furled canvas 22 and cross-member 20 can be further secured within the housing 14. As shown in FIGS. 14 and 15, the end caps 42, 44 of the housing 14 can each include an elastic cord 80, 82 mounted thereto. When the furled canvas 22 and cross-member 20 are positioned within the housing 14, each of the elastic cords 80, 82 can be positioned about the adjacent cross-member elbows 58, 60.

Figure 16:
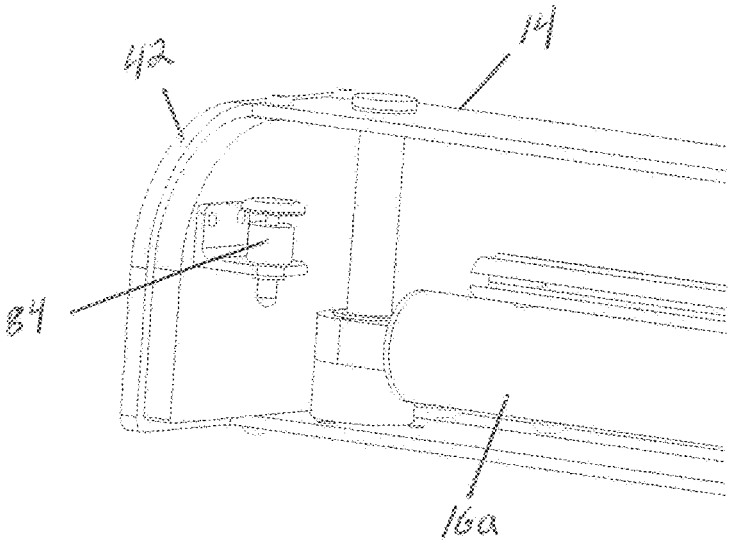
FIG. 16 depicts a partial sectional view of a spring-load pin locking element of the retractable shade system of FIG. 1.
Figure 17:
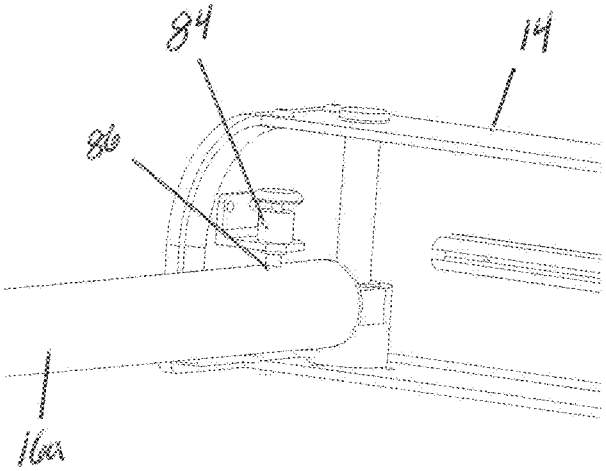
FIG. 17 depicts a partial sectional view of the spring-load pin locking element of FIG. 16 engaging a swing arm.

In an embodiment, the unfolded telescoping swing arms 16, 18 can be secured in position with a locking pin. Referring to FIGS. 16 and 17, a spring load locking pin 84 can be affixed to the end cap 42 of the housing 14. When the telescoping swing arm 16 is rotated out of the housing 14, adjacent to the end cap 42, the spring-loaded locking pin 84 is raised to engage a locking hole 86 on an upper surface of the outer tube 16*a* of the telescoping swing arm 16. To release telescoping swing arm 16, the spring-loaded locking pin 84 is raised and telescoping swing arm 16 is rotated into the housing 14. While not shown in the figures, telescoping swing arm 18 can be secured with the same spring-loaded locking pin configuration.

Figure 18:
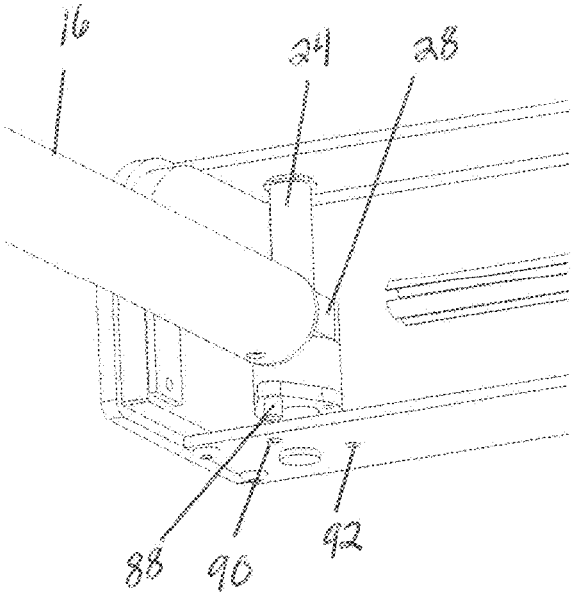
FIG. 18 depicts a partial sectional view of a pin locking element on an end of a swing arm of the retractable shade system of FIG. 1.
Figure 19:
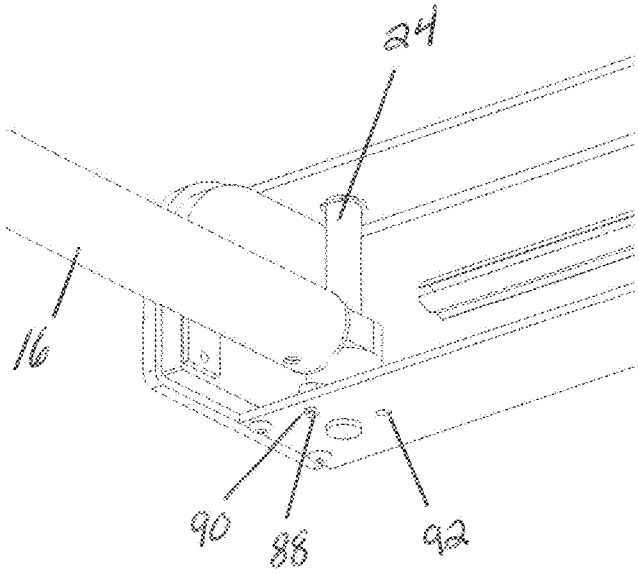
FIG. 19 depicts a partial view of the locking pin element of FIG. 18 engaging the housing.

Referring to FIGS. 18 and 19, in another embodiment the telescoping swing arm 16 can be secured in position with a locking pin 88 affixed to the eye bracket 28. To rotate the telescoping swing arm 16 out of the house 14, the telescoping swing arm 16 is slid up the pivot pin 24, and rotated out, adjacent to the end cap 42. The locking pin 88 is positioned above an extended locking hole 90 on the housing 14.

Telescoping swing arm 16 in slid down the pivot pin 24 such that locking pin 88 is lowered to engage the extended locking hole 90. To release swing arm 16, the swing arm 16 is slid up the pivot pin 24, removing the locking pin 88 from the extended locking hole 88, and rotated into the housing 14. In the housing 14, the locking pin 88 can be aligned with and positioned in a retracted locking hole 92 to secure the telescoping swing arm 16 in the housing 14. While not shown in the figures, telescoping swing arm 18 can be secured in the unfolded position with a similar locking pin 88/extended locking hole configuration.

Figure 20:
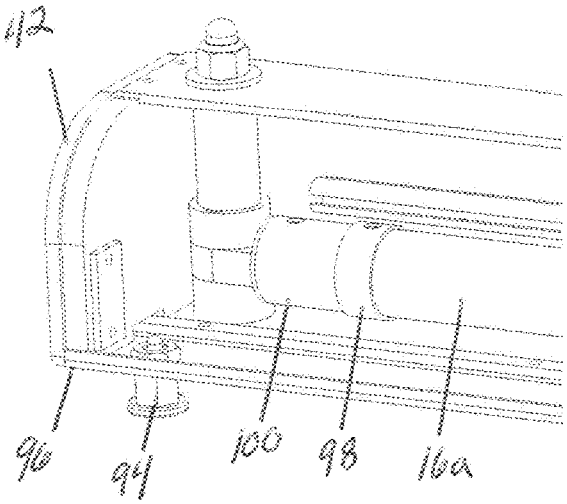
FIG. 20 depicts a partial sectional view of a spring-load pin locking element of the retractable shade system of FIG. 1.
Figure 21:
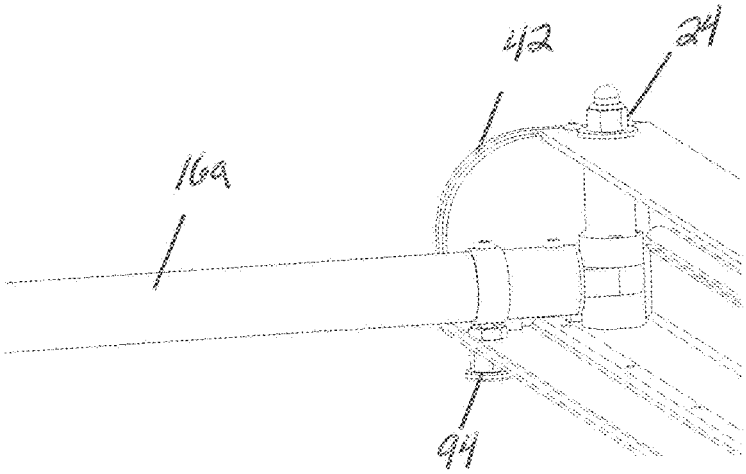
FIG. 21 depicts a perspective view of an unfolded swing arm secured with the locking pin of FIG. 20.

Referring to FIGS. 20 and 21, a spring load locking pin 94 can be affixed to and extending through a bottom surface 96 of the housing 14, adjacent to the end cap 42. Note that the bottom surface 96 of the housing 14 can be a separate piece, affixed to the housing 14, or an integrated portion of the housing 14. When the telescoping swing arm 16 is rotated out of the housing 14, adjacent to the end cap 42, the spring-loaded locking pin 94 is pulled to engage a locking hole 98 on a bottom surface 100 of the outer tube 16*a* of the telescoping swing arm 16. To release telescoping swing arm 16, the spring-loaded locking pin 94 is pulled out and telescoping swing arm 16 is rotated into the housing 14. While not shown in the figures, telescoping swing arm 18 can be secured with the same spring-loaded locking pin configuration.

Figure 22:
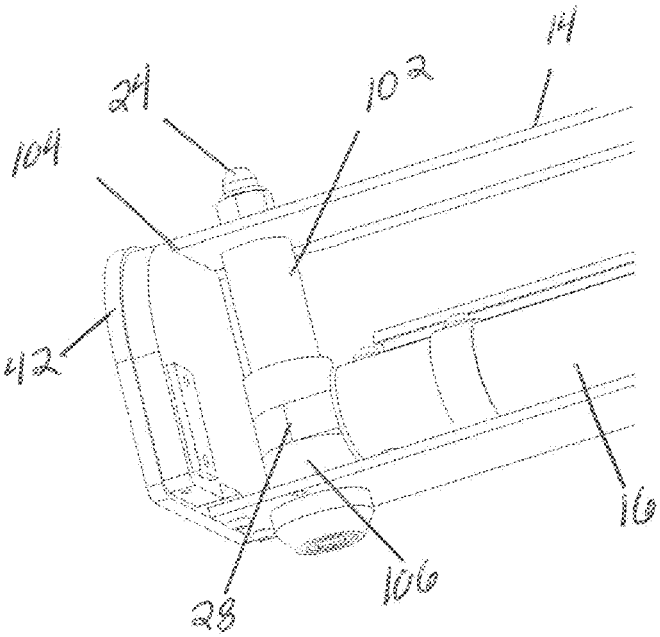
FIG. 22 depicts a partial sectional view an alternative pivoting element of the swing arms of the retractable shade system.

Referring to FIG. 22, the pivot pin 24 of telescoping swing arm 16 can include an outer sleeve 102. The outer sleeve 102 is positioned on the upper portion 104 of the pivot pin 24, above the eye bracket 28. In this position, the outer sleeve 102 prevents the eye bracket 28 from sliding along the vertical length of the pivot pin 24, while still permitting the telescoping swing arm 16 to be rotated about the pivot pins 24. With the use of the outer sleeve 102, the telescoping swing arm 16 is maintained at a lower end 106 of the pivot pin 24.

Figure 23:
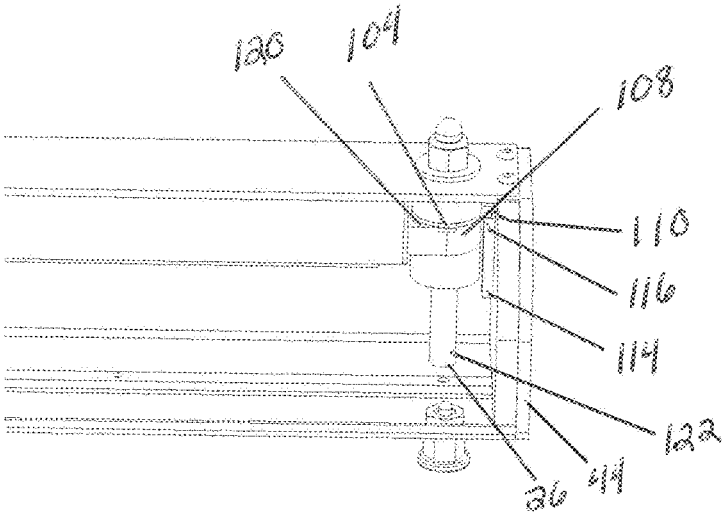
FIG. 23 depicts a partial sectional view an alternative pivoting element with a locking block of the swing arms of the retractable shade system.
Figure 24:
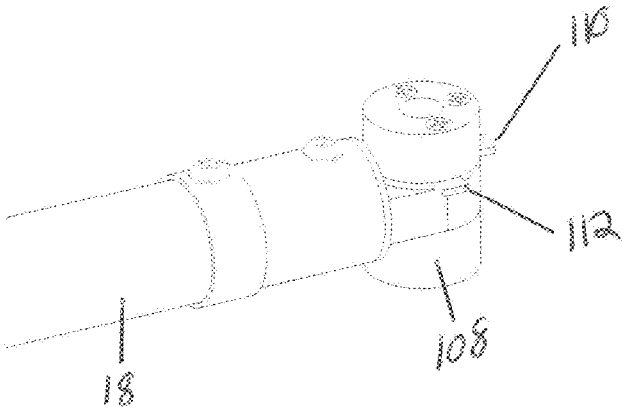
FIG. 24 depicts a view of an eye bracket for use with the locking block of FIG. 23.
Figure 25:
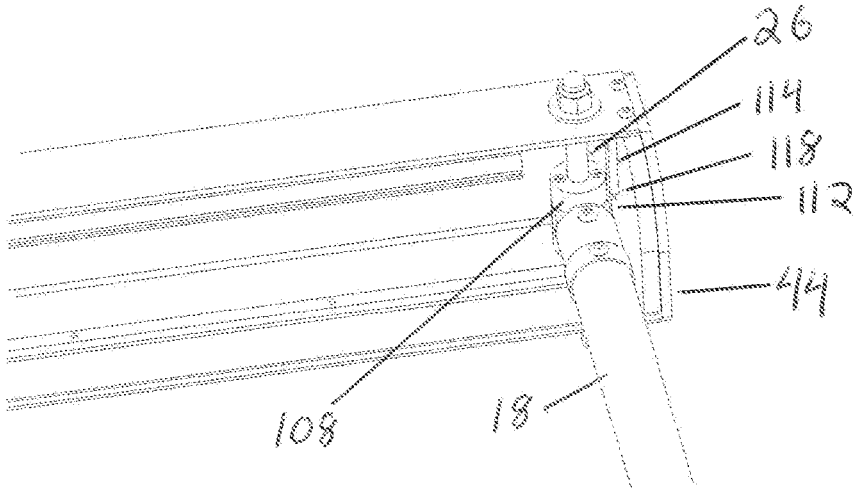
FIG. 25 depicts a partial perspective view of the eye bracket engaging the locking block when the swing arm is unfolded.

Referring to FIG. 23-25, the telescoping swing arms 18 is connected to pivot pin 26, with an eye bracket 108. The eye bracket 108 permits the telescoping swing arms 18 to be rotated about pivot pin 26, and well as being vertically slidable along the length of the pivot pin 26. The eye bracket 108 further includes a pair to locking tabs 110, 112 which selectively engage a locking block 114 on the end cap 44 of the housing 14. To fold the telescoping swing arm 18, the telescoping swing arm 18 is positioned at an upper end 120 of the pivot pin 26. When rotated into the housing 14, the first locking tab 110 engages a top surface 116 of the locking block 114, preventing the telescoping swing arm 18 from sliding down the pivot pin 26. In this configuration, telescoping swing arm 18 is positioned above telescoping swing arm 16 within the housing 14.

To unfold the swing arm 18, the swing arm 18 is rotated out of the housing, and slid down the pivot pin 26, to a lower end 122 of the pivot pin 26. When fully rotated out of the housing 14, the second locking tab 112 engages a bottom end 118 of the locking block 114, preventing the swing arm 18 from sliding up the pivot pin 26.

Figure 26:
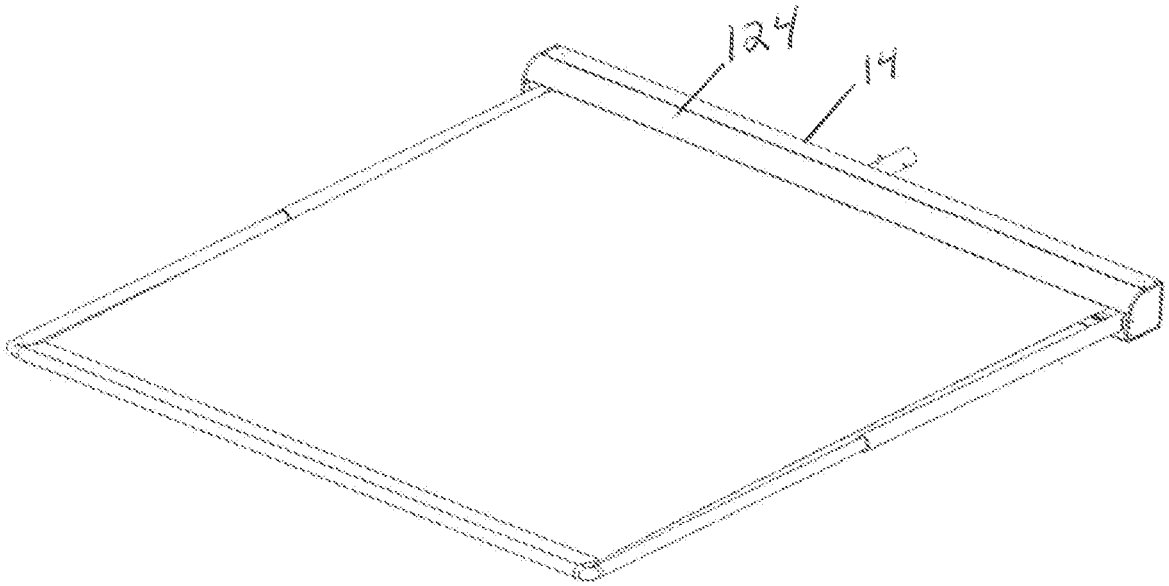
FIG. 26 depicts a top cover of the housing of the retractable shade system of FIG. 1.
Figure 27:
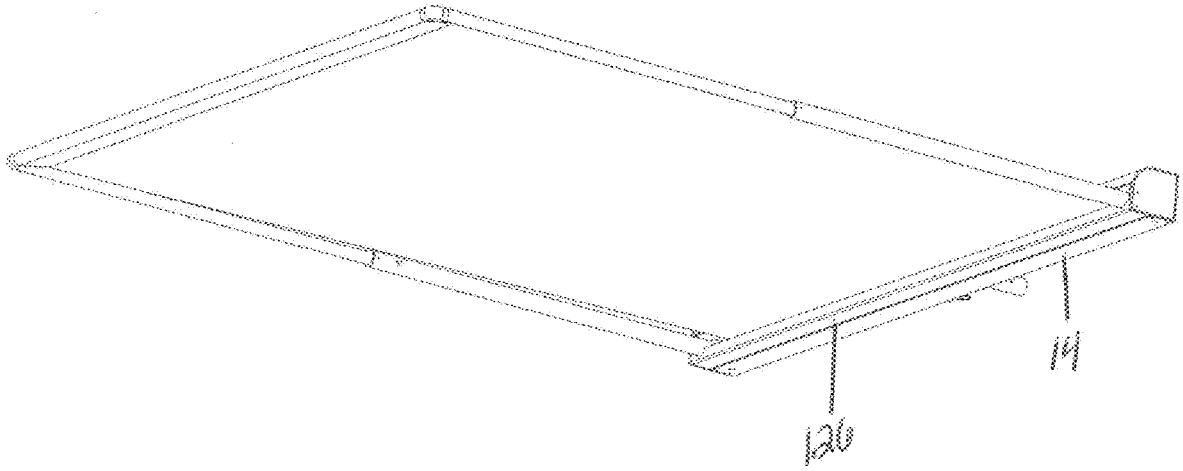
FIG. 27 depicts a bottom cover of the housing of the retractable shade system of FIG. 1.

In embodiment, as shown in FIGS. 26 and 27, the housing 14 can include top and bottom covers 124, 126. The top covers 124 can be removable attached to the housing 14, allowing for access to expand and retract the telescoping swing arms 16, 18 and canvas 22. Alternatively, the top cover 124 can be rotatably connected to the housing 14, such that the top cover 124 can be rotated up to expand and retract the telescoping swing arms 16, 18 and canvas 22. The bottom cover 126 is affixed to the housing 14, being utilized to support the cross-member 20 and furled canvas 22.

Figure 28:
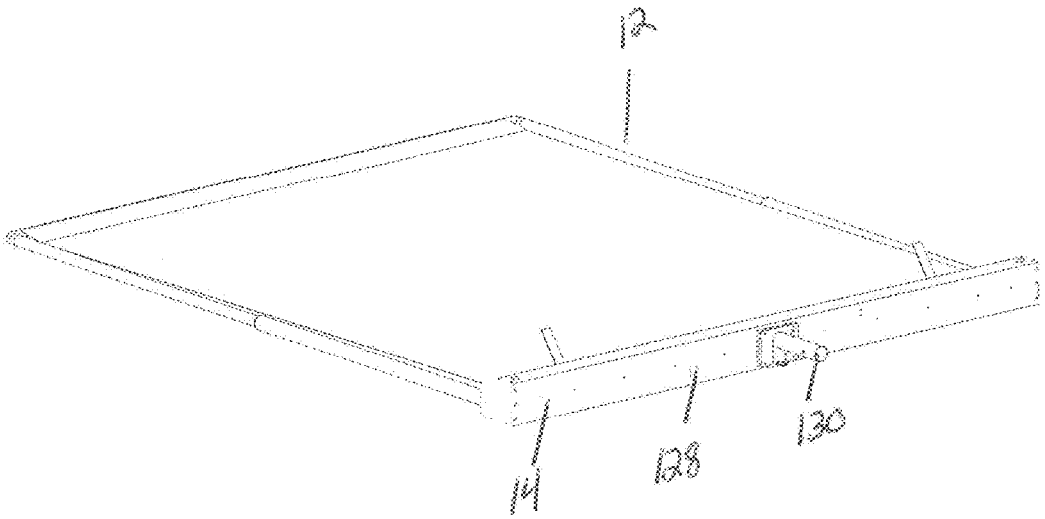
FIG. 28 depicts a mounting shaft for use with the retractable shade system of FIG. 1.
Figure 29:
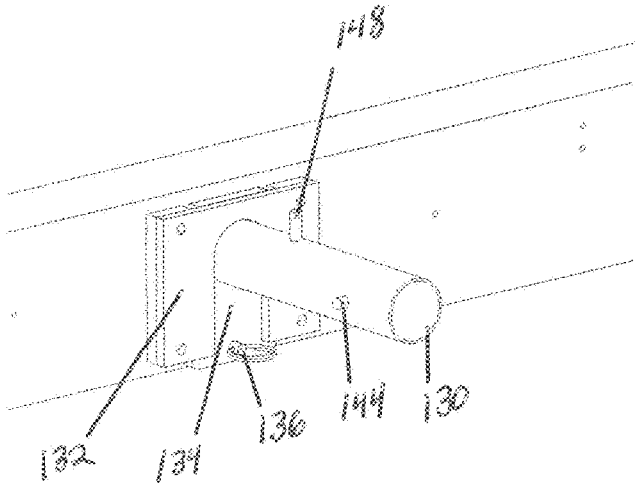
FIG. 29 depicts a close-up view of the mounting shaft of FIG. 28.

The retractable shade system 12 can be removable attached to an existing boat stop structure 10 by a variety of means. Referring to FIGS. 28 and 29 a back surface 128 of the housing 14 of the retractable shade system 12 can include a mounting shaft 130. The mounting shaft 130 can be permanently or removably attached to the housing 14. In on embodiment, the back surface 128 of housing include a mounting bracket 132. The mounting shaft 130 is affixed to a mounting plate 134, where the mounting bracket 132 is configures to slidingly receive the mounting plate 134. The mounting plate 134 can be secured with the mounting bracket 132 with a detent pin 136.

Figure 30:
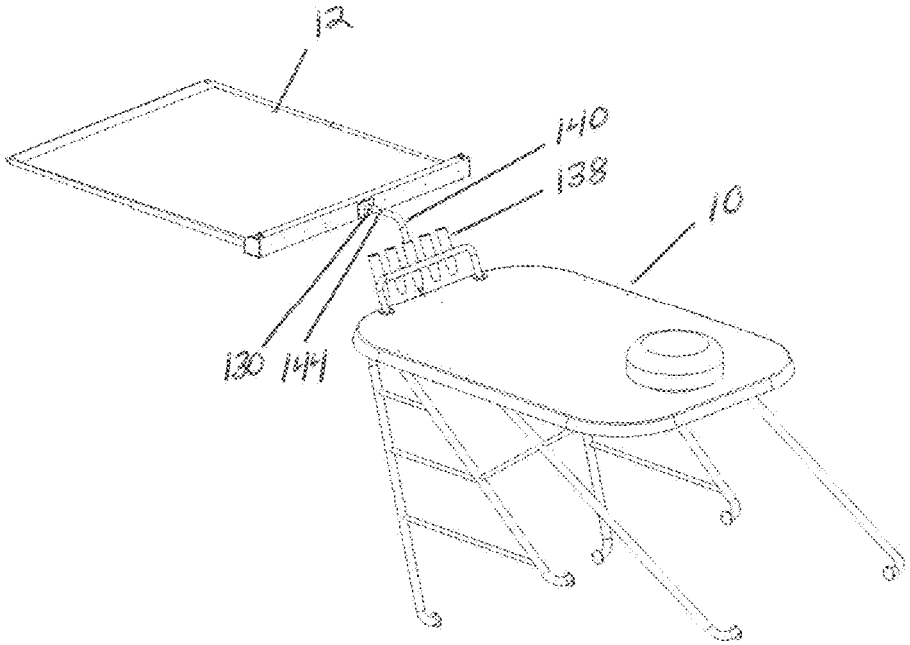
FIG. 30 depicts the retractable shade system of FIG. 1 mounted to a rod holder on an existing boat top structure.
Figure 31:
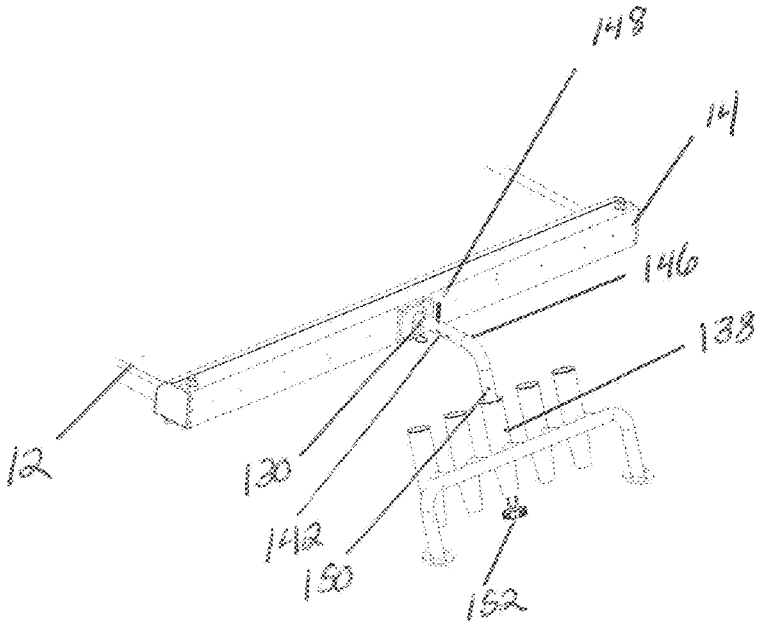
FIG. 31 depicts an isolated view of the retractable shade system of FIG. 1 mounted to a rod holder of FIG. 30.
Figure 32:
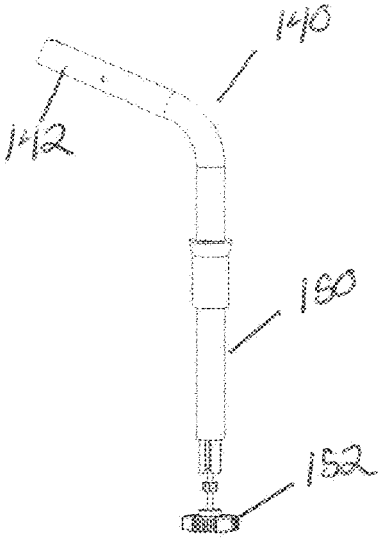
FIG. 32 depicts a shade mount to connect the retractable shade system of FIG. 1 to a rod holder.

The mounting shaft 130 can be used to secure the retractable shade system 12 to the existing boat top structure 10 by a variety of means. In an embodiment, as shown in FIGS. 30-32 and, the retractable shade system 12 is secured to a fishing rod holder 138 on the existing boat stop structure 10. A shade mount 140 is connected the mounting shaft 130 at a first end 142. A detent pin 144 can be used to secure the mounting shaft 130 to the shade mount 140. The mounting shaft 130 can be slid into a first end 142 of the shade mount 140, where guide slot 146 engages a guide pin 148 on the mounting shaft 130. The guide pin 148 aligns the position of the retractable shade system 12 with the shade mount 140, as well as preventing a rotation of the mounting shaft 130 with respect to the shade mount 140.

A second end 150 of the shade mount 140 is positioned though a rod holder 108. The shade mount 140 can be secured within the rod holder 138 with a locking screw 152. The locking screw 152 can be used to draw the shade mount 140 into the rod holder 138, compressing the shade mount 140 within the rod holder 138, using frictional forces to lock it into place. Additionally, the shade mount 140 can be curved in shape, such that the first end 142 of the shade mount 140 positions the retractable shade system 12 substantially parallel to the deck of the boat.

Figure 33:
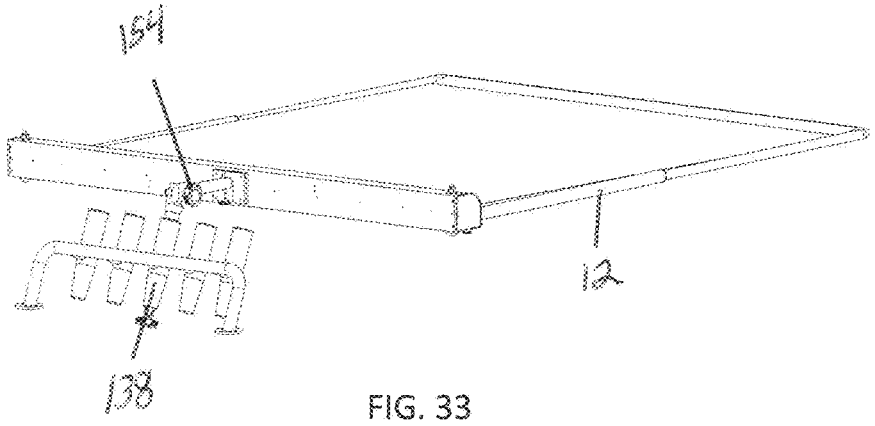
FIG. 33 depicts an isolated view of the retractable shade system of FIG. 1 mounted to a rod holder with an adjustable shade mount.
Figure 34:
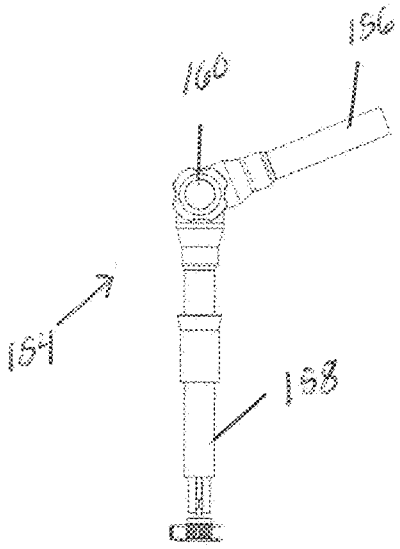
FIG. 34 depicts an adjustable shade mount to connect the retractable shade system of FIG. 1 to a rod holder.

In an embodiment, as shown in FIGS. 33 and 34, the retractable shade system 12 is secured to the fishing rod holder 138 with an adjustable shade mount 154. The adjustable shade mount 154 secures the retract cover 12 to the fishing rod holder 138 in the same fashion as the shade mount 140, as described above, but further include an adjustable connection between the first and second ends 156, 158 of the adjustable shade mount 154. The first and second ends 156. 158 of the adjustable shade mount 154 are connected with an adjustment screw 160, allow for the first and second ends 156, 158 to be moved with respect to each other. The adjustment screw 160 can be loosen, allowing the angle of the first end 156 of the adjustable shade mount 154 to be moved with respect to the second end 158, to adjust the position of the retractable shade system 12 with respect to the deck of the boat. The adjustment screw 160 is tighten the secure the position of the retractable shade system 12.

Figure 35:
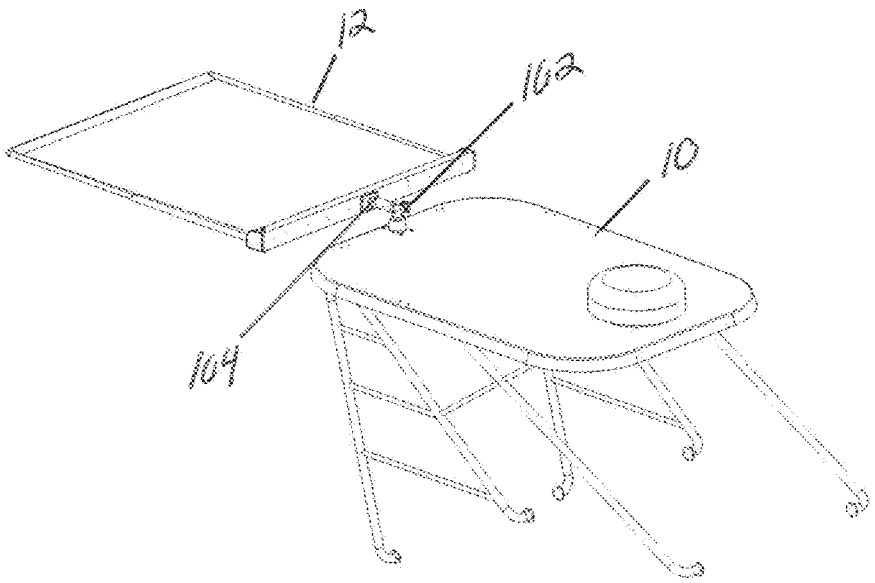
FIG. 35 depicts the retractable shade system of FIG. 1 mounted to an outrigger holder on an existing boat top structure.

In another embodiment, the retractable shade system 12 can be connected to the existing boat top structure 10 with an adjustable position outrigger mount 162. Referring to FIG. 35, an outrigger mount 162 is connected to the existing boat top structure 10. The mounting shaft 130 is connected to an outrigger holder 164 portion of the outrigger mount 162 is a similar fashion as to the first end 142 of the shade mount 140, as described above.

Figure 36:
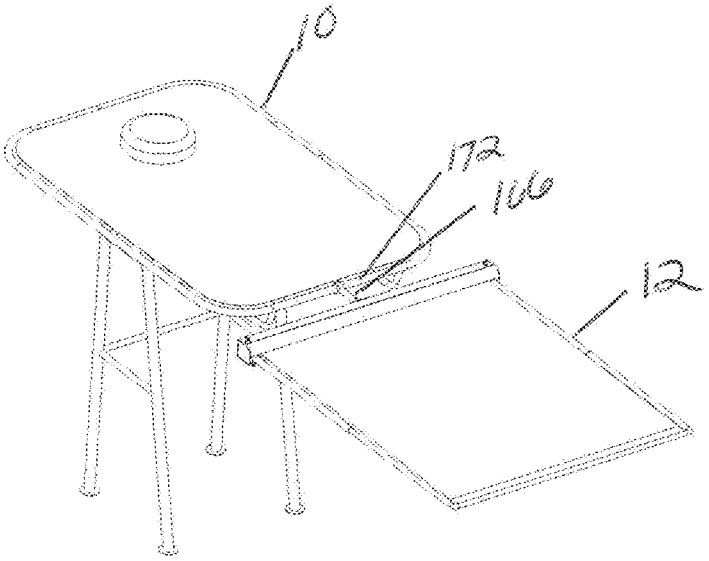
FIG. 36 depicts the retractable shade system of FIG. 1 mounted to existing boat top structure with a mounting clamp.
Figure 37:
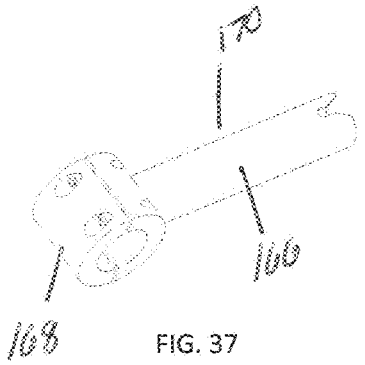
FIG. 37 depicts a mounting clamp to connect the retractable shade system of FIG. 1 to existing boat top structure.

In another embodiment, the retractable shade system 12 can be connected to the existing boat top structure 10 with a mounting clamp 166. Referring to FIGS. 36 and 37, a mounting clamp 166 can be connected to the existing boat top structure 10. The mounting clamp 166 includes a clamp portion 168 and a holder portion 170. The clamp portion 168 of the mounting clamp 166 can be connect to a tubular portion 172 of the existing boat top structure 10. The mounting shaft 130 is connected to a holder portion 170 of the mounting clamp 166 is a similar fashion as to the first end 142 of the shade mount 140, as described above.

Figure 38:
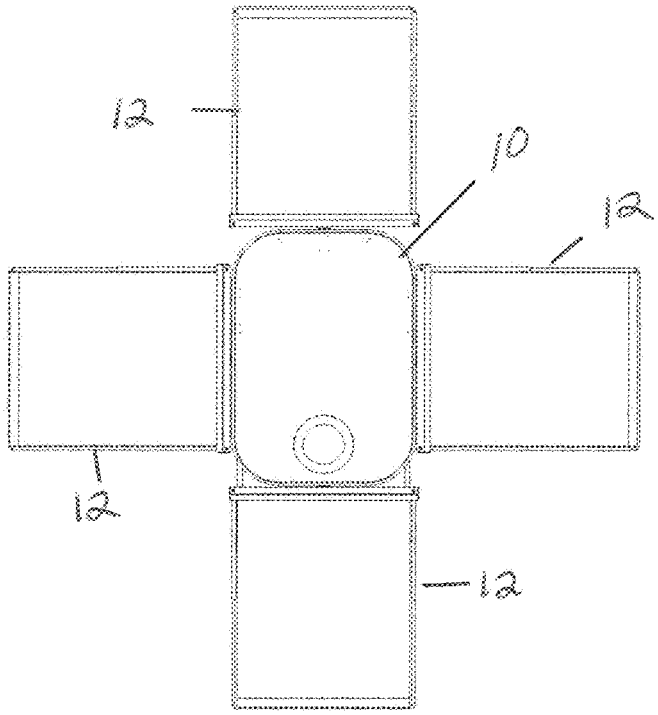
FIG. 38 depicts multiple retractable shade systems mounted to an existing top structure.

Referring to FIG. 38, the above-described mount system can be used to mount multiple retractable shade system to differ portions of the exist boat top structure 10.

Figure 39:
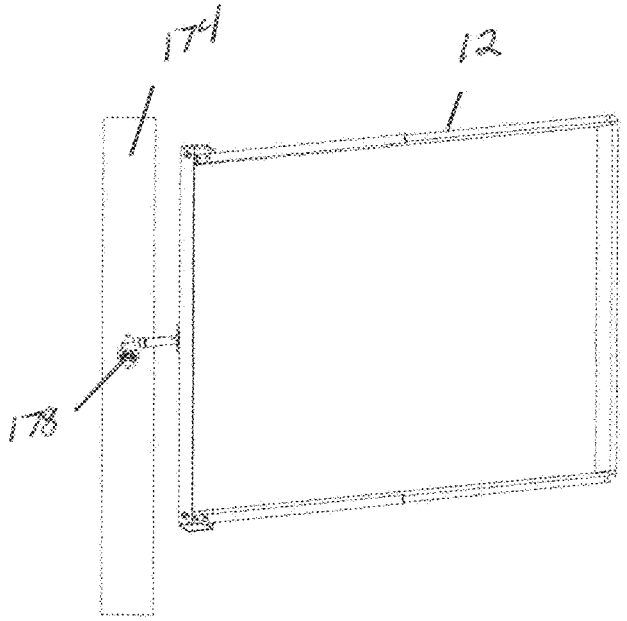
FIG. 39 depicts a top view of the retractable shade system of FIG. 1 mounted to a gunnel of a boat.
Figure 40:
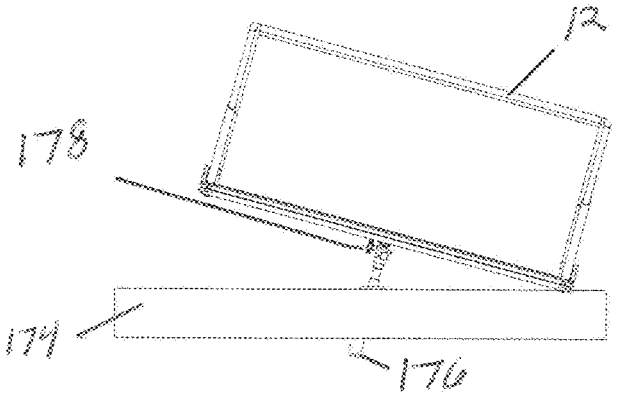
FIG. 40 depicts a side view of the retractable shade system of FIG. 1 mounted to a gunnel of the boat.
Figure 41:
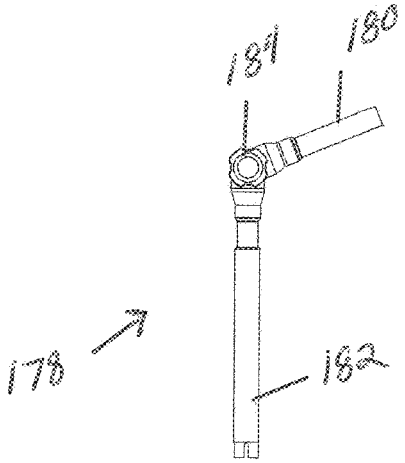
FIG. 41 depicts an adjustable gunnel mount to connect the retractable shade system of FIG. 1 to a gunnel of the boat.

The retractable shade system 12 can be removable attached to a gunnel of a boat. Referring to FIGS. 39-41, the gunnel 174 can include a gunnel rod holder 176. A gunnel mount 178 is connected the mounting shaft 130 at a first end 180. The mounting shaft 130 is connected to a first end 180 of the gunnel mount 178 in a similar fashion as to the first end 142 of the shade mount 140, as described above. The second end 182 of the gunnel mount 178 is secured in the gunnel rod holder 176 in a similar fashion as the second end 150 of the shade mount 140 is secured in the rod holder 138, as described above. Note that the screw 152 is only usable for an open gunnel.

Similar to the adjustable shade mount 154, the gunnel mount 178 includes adjustable connection between the first and second ends 180, 182. The first and second ends 180, 182 of the gunnel mount 178 are connected with an adjustment screw 184, allow for the first and second ends 180, 182 to be moved with respect to each other. The adjustment screw 184 can be loosen, allowing the angle of the first end 180 of the gunnel mount 154 to be moved with respect to the second end 182, to adjust the position of the retractable shade system 12 with respect to the deck of the boat. The adjustment screw 184 is tighten the secure the position of the retractable shade system 12.

Figure 42:
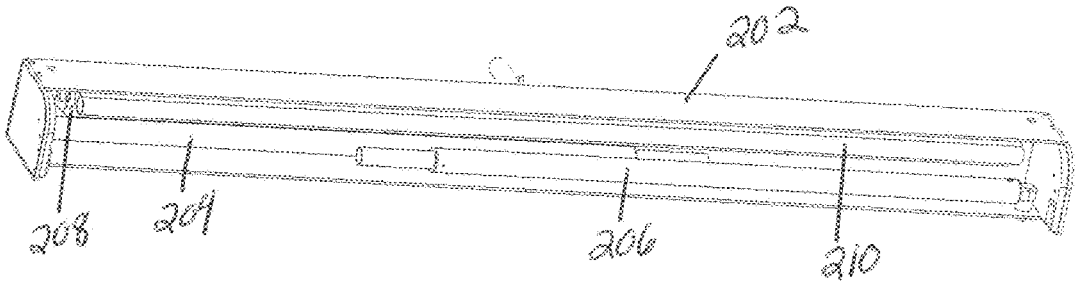
FIG. 42 depicts a perspective view of the stowed, furled, alternative retractable shade system of the present invention.
Figure 43:
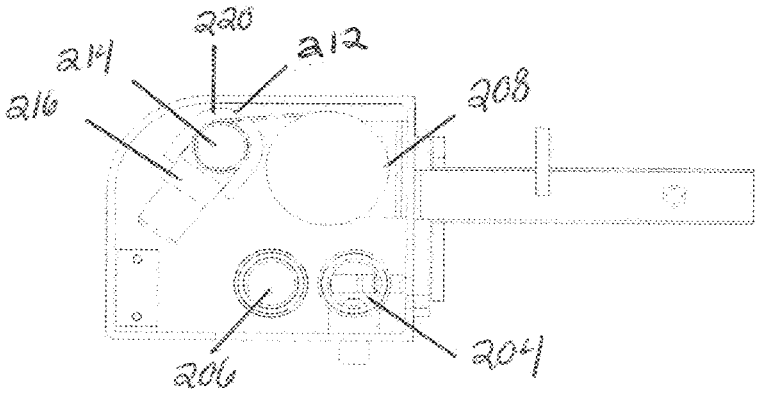
FIG. 43 depicts a side sectional view of the stowed, furled, cover of the retractable shade system of FIG. 42.

In another embodiment, a retractable shade system can include a canvas cover mounted on a spring-loaded roller, allowing for an automatic furling of the canvas cover. Referring to FIGS. 42 and 43, a retractable shade system 200 can include a base housing 202 with a pair of pivotal telescoping swing arms 204, 206. A spring-loaded roller 208 is mounted in the housing 202, where a canvas cover 210 is connected at one end to the spring-loaded roller 208. The second, opposite, end 212 of the canvas cover 210 is attached to the cross-member 214. The cross member 214 can include cross-member elbows 216, 218 positioned at opposite ends. To store the canvas cover 210, the canvas cover 210 is furled about the spring-loaded roller 208 and the cross-member elbows 216, 218 are positioned in support cups 220, 222 within the housing 202. The canvas cover 210 is furled about the spring-load roller 208, with the spring being in a loaded condition, such that a tension is imparted on the cross member 214. The tension in the cross member 214, helps hold and support the cross-member elbows 216, 218 in the support cups 220, 222.

The telescoping swing arms 204, 206 are each connected to a pivot pin 224, 226 positioned at opposite ends of the housing 202. The telescoping swing arms 204, 206 each include an eye bracket 228 connected to an end thereof, where the eye brackets 228 are positioned about the respective pivot pins 224, 226. The configuration of the eye brackets 228 permits the telescoping swing arms 204, 206 to be rotated about their respective pivot pins 224, 226.

Figure 44:
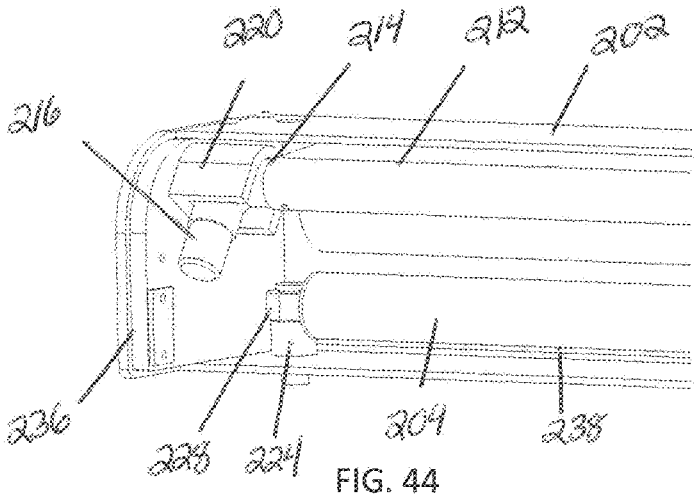
FIG. 44 depicts a partial sectional view of a first end of the housing of the retractable shade system of FIG. 42.
Figure 45:
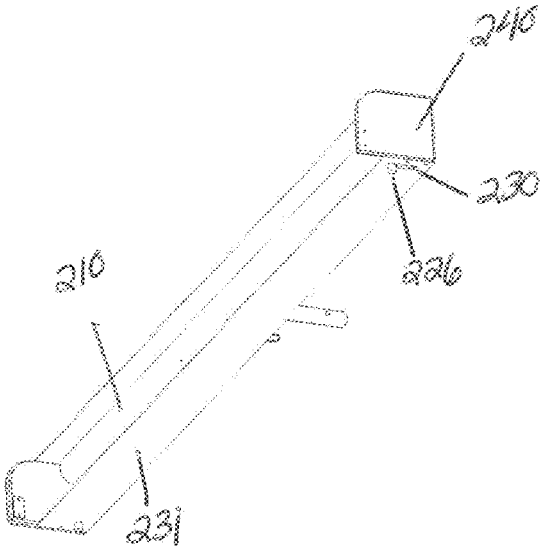
FIG. 45 depicts a bottom perspective view of the housing of the retractable shade system of FIG. 42.
Figure 46:
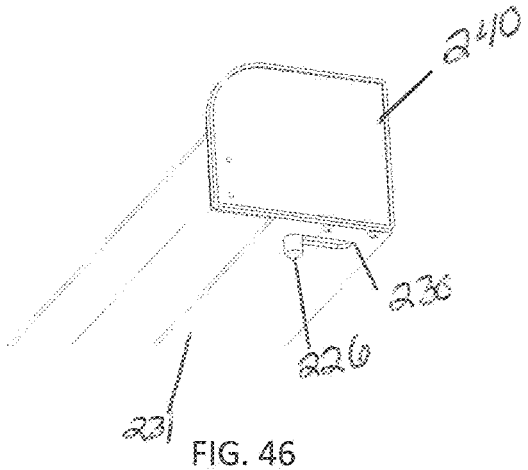
FIG. 46 depicts a partial bottom sectional view of a second end of the housing of the retractable shade system of FIG. 42.
Figure 47:
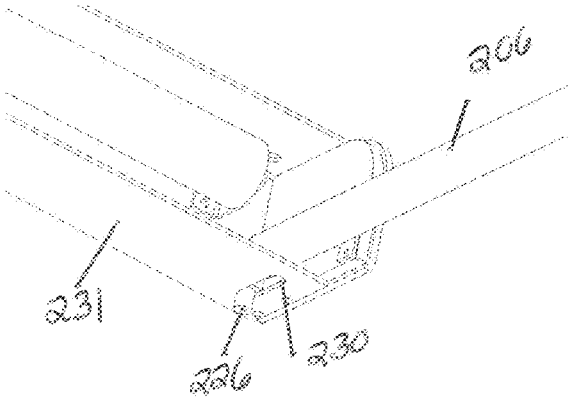
FIG. 47 depicts a partial bottom sectional view of a second end of the housing of the retractable shade system of FIG. 42 with an un folded telescoping swing arm.

Referring to FIG. 44, telescoping swing arm 204 is connected to a fixed positioned pivot pin 224. In contrast, as shown in FIGS. 45-47, telescoping swing arm 206 is connected to a sliding pivot pin 226. The sliding pivot pin 226 is positioned in a slot 230 in a base 232 of the housing 202, allowing for the sliding pivot pin 226 and end of the telescoping swing arm 206 to be moved along the length of the slot 230. In this manner, in the retracted position the telescoping swing arms 204, 206 can be folded into the housing in a substantially parallel, planar, position.

In an example, pivot pin 224 is positioned in a back corner of the housing, adjacent to side wall 236 and back surface 238 of the housing 202. In this position, folder swing arm 204 is positioned adjacent to back surface 238 of the housing 202. Pivot pin 226 is position in slot 230 in the bottom surface 231 of the housing 202, where slot 230 is adjacent to side wall 240 of the housing 202. Utilizing the slot 230, when telescoping swing arm 206 is folded into the housing 202, the pivot pin 226 is moved to a front end of the slot 230. In this position, telescoping swing arm 206 is folded in front of telescoping swing arm 204 in the housing 202.

To expand the retractable shade system 202, the telescoping swing arms 204, 206 are each unfolded, rotated, about their respective pivot pins. Telescoping swing arm 206 is first rotated out the housing 202, and pivot pin 226 is moved along the slot 230 to a back corner of the housing 202. Telescoping swing arm 206 has a nested tube system as has been previously described above and shown in FIGS. 7 and 8, and extended and locked in position in the same manner as described. Telescoping swing arm 204 is likewise rotated out of the housing 202, about pivot pion 224. Telescoping swing arm 204 has a nested tube system as has been previously described above and shown in FIGS. 7 and 8, and extended and locked in position in the same manner as described.

When both telescoping swing arms 204, 206 are locked in their extended positions, the canvas cover 210 is unfurled from the spring-loaded roller 208. The cross-member elbows 216, 218 are positioned within the open ends of the respective telescoping swing arms as described above, forming a support structure to support canvas. The tension in the spring roller 208 imparts a tension on the canvas cover 210. This also serves to hold the cross-member elbows 216, 218 within the open ends.

To retract the retractable shade system 200, cross-member 214 is separated from the telescoping swing arms 204, 206 by removing the cross-member elbows 216, 218 from the open ends of the telescoping swing arms 204, 206. The tension in the spring-loaded roller 208 automating furls the canvas cover 210 is about spring-loaded roller 208 for positioned in the housing 202 as describe above.

Each on the telescoping swing arms 204, 206 is retracted as has been previously described above. Each of the telescoping swing arms 204, 206 are folded in the housing 202 as has be previously descript. The folded telescoping spring arms 204, 206 can be secured in the housing as has been previously described above.

Figure 48:
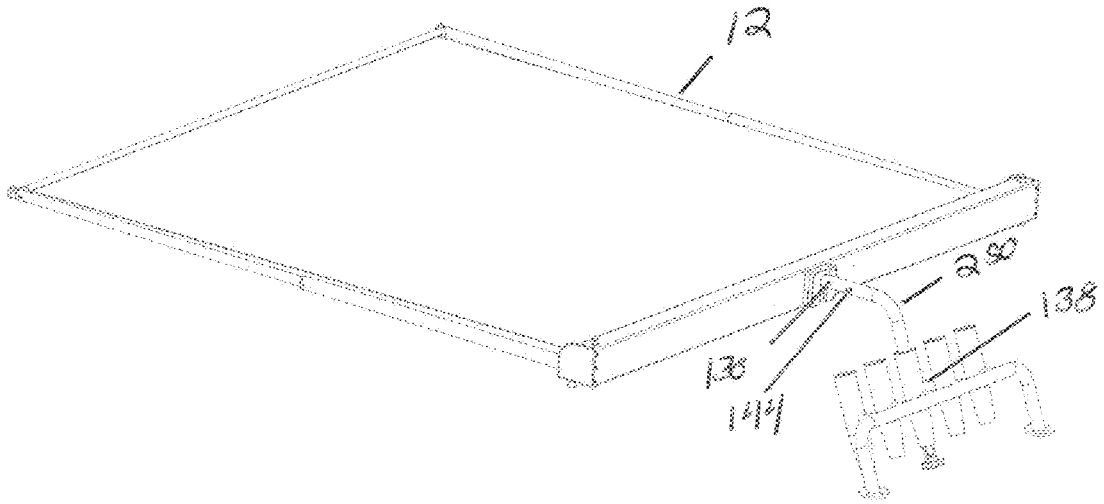
FIG. 48 depicts the retractable shade system mounted to a rod holder on an existing boat top structure with an alternative shade mount.
Figure 49:
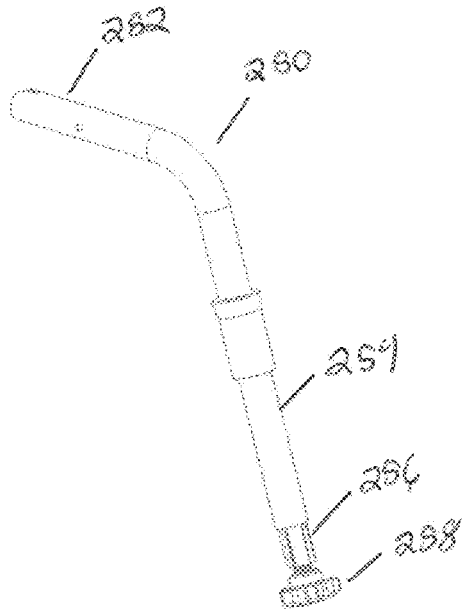
FIG. 49 depicts the alternative shade mount to connect the retractable shade system of FIG. 1 to a rod holder.
Figure 50:
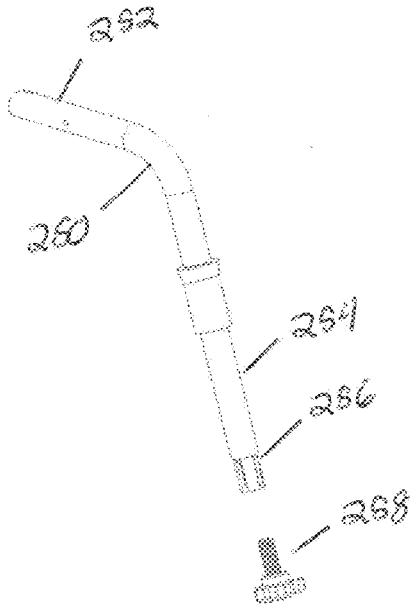
FIG. 50 depicts another view of the alternative shade mount of FIG. 49.

Referring FIGS. 48-50 an alternative shade mount 250 in provided. As described in FIGS. 30-32, the retractable shade system 12 is secured to a fishing rod holder 138 on the existing boat stop structure 10. A shade mount 250 is connected the mounting shaft 130 at a first end 142. A detent pin 144 can be used to secure the mounting shaft 130 to the shade mount 250. The mounting shaft 130 can be slid into a first end 252 of the shade mount 250

A second end 254 of the shade mount 250 is positioned though a rod holder 108. The second end 254 of the shade mount 250 included a sectioned internally threaded end 256. A locking screw 258 is threadably positionable within sectioned internally threaded end 256.

Figure 51:
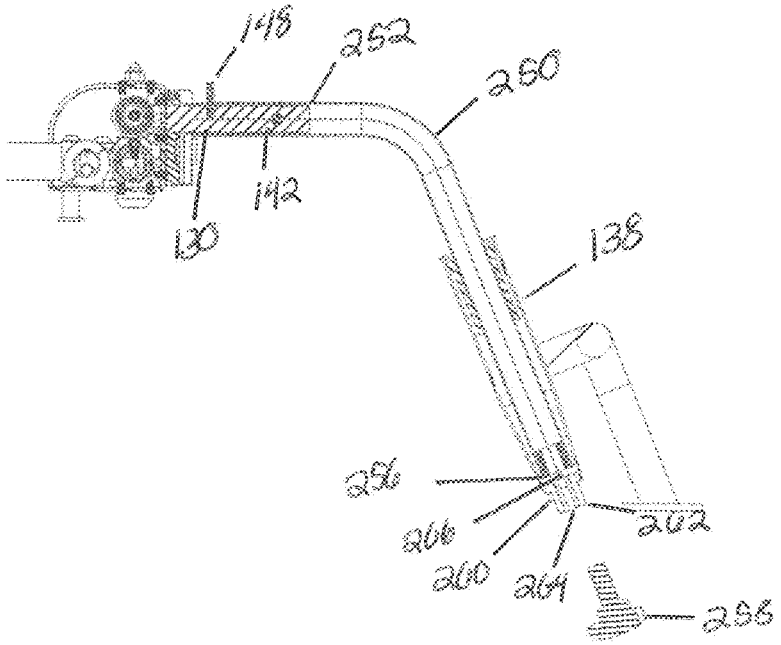
FIG. 51 depicts a sectional view of the alternative shade mount of FIG. 49.
Figure 52:
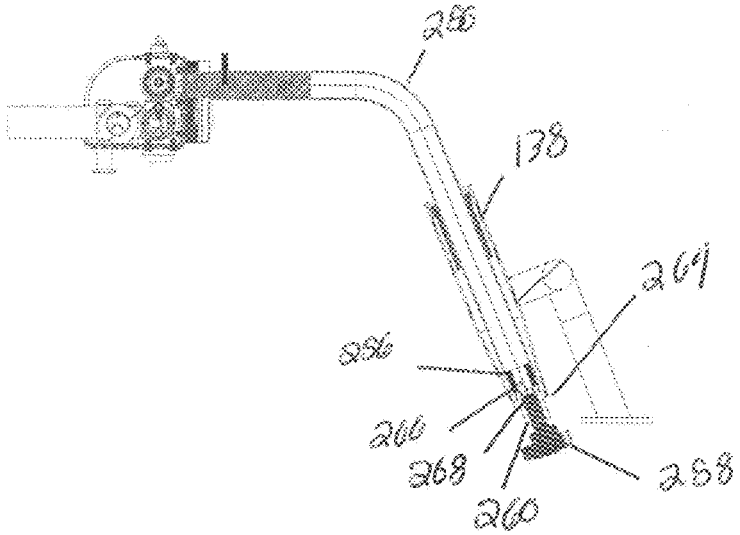
FIG. 52 depicts another sectional view of the alternative shade mount of FIG. 49.

Referring also to FIGS. 51-52, the sectioned internally threaded end 256 includes at least pair of opposing spaced apart sections 260, 262, forming a gap 264 therebetween. When the second end 254 of the shade mount 250 is positioned though a rod holder 108, an internal cross member 266 is positioned in the gap 264, between pair of opposing spaced apart sections 260, 262.

The shade mount 250 can be secured in the rod holder 138 with the locking screw 258. The locking screw 258 can be used to draw the shade mount 250 into the rod holder 138, where an end 268 of the locking screw compressed against the internal cross member 266 in the shade mount 252. Additionally, the shade mount 250 can be curved in shape, such that the first end 252 of the shade mount 252 positions the retractable shade system 12 substantially parallel to the deck of the boat.

Figure 53:
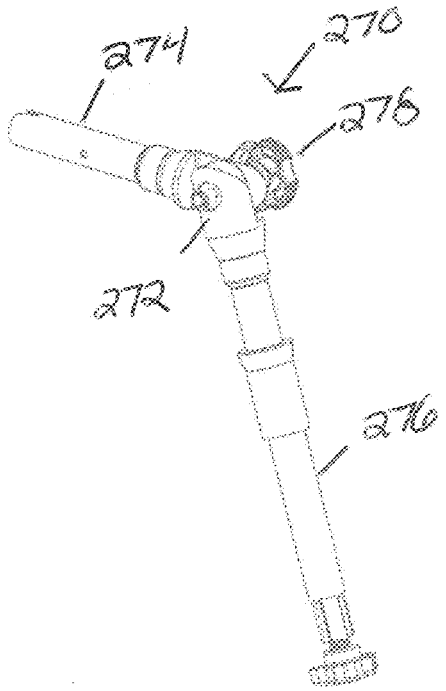
FIG. 53 depicts an alternative adjustable shade mount to connect the retractable shade system of FIG. 1 to a rod holder.

Referring to FIG. 53, and similarly describe above and shown in FIGS. 33 and 34, the shade mount 250 can be an adjustable shade mount 270. The adjustable shade mount 270 secures the retract cover 12 to the fishing rod holder 138 in the same fashion as the shade mount 250, as described above, but further include an adjustable connection 272 between the first and second ends 274, 276 of the adjustable shade mount 270. The first and second ends 274, 276 of the adjustable shade mount 270 are connected with an adjustment screw 278, allow for the first and second ends 274, 276 to be moved with respect to each other. The adjustment screw 278 can be loosen, allowing the angle of the first end 274 of the adjustable shade mount 270 to be moved with respect to the second end 276, to adjust the position of the retractable shade system 12 with respect to the deck of the boat. The adjustment screw 278 is tighten the secure the position of the retractable shade system 12.

Figure 54:
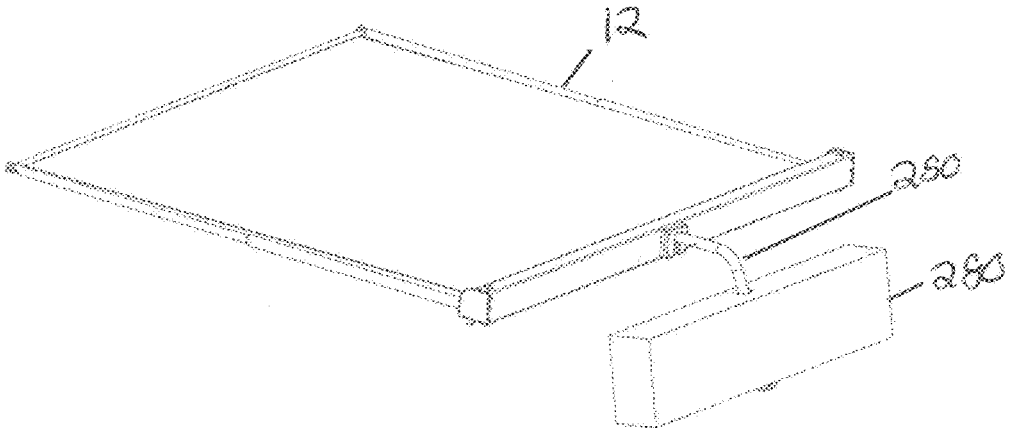
FIG. 54 depicts the retractable shade system mounted to an open gunnel of a boat.
Figure 55:
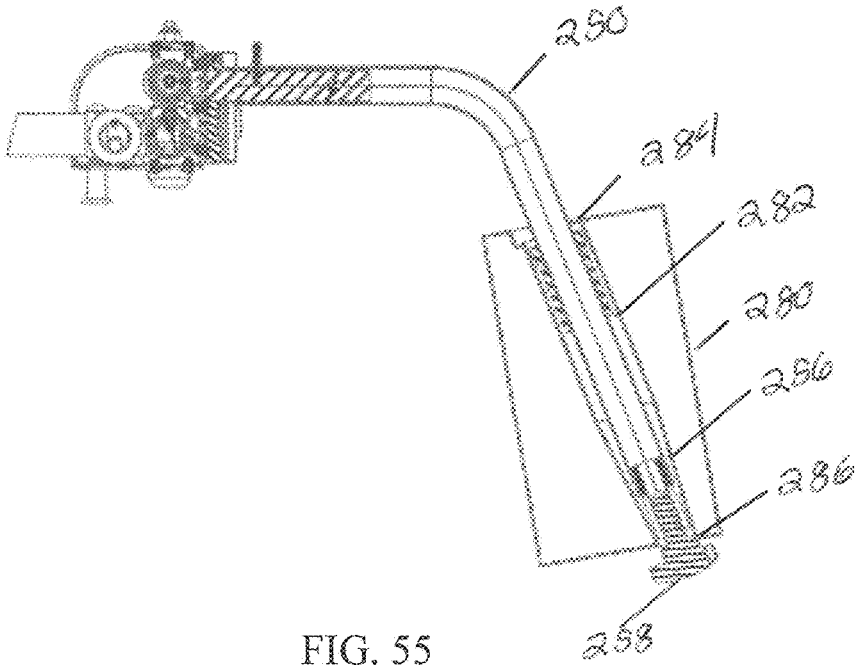
FIG. 55 depicts a section view of the retractable shade system mounted to an open gunnel of a boat

In another embodiment, the retractable shade system 12 can be connected to the open gunnel 280 of a boat. Referring to FIGS. 54 and 55, an open gunnel 280 has a gunnel shaft 282 with an open top end 284 and an open and accessible bottom end 286. A second end 254 of the shade mount 250 is positioned though at the top end of 284 of the gunnel shaft 282, where the second end 254 of the shade mount 250 extends through the bottom end 286 of the gunnel shaft 282. The shade mount 250 can be secured in the gunnel shaft 282 in with a locking screw 258 in a similar manner as described about for shade mounts 140 and 250.

All references cited herein are expressly incorporated by reference in their entirety.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A shade mount for mounting a shade to an existing boat structure comprising:

a first end;

a second end positionable in a holder in the existing boat structured and including an internally thread section, wherein the internally threaded section of the second end includes at least two spaced apart sections defining a gap therebetween;

a locking screw threadable into the internally threaded section of the second end to secure the shade mount in the holder of the existing boat structure, wherein the at least two spaced apart sections expand as the locking screw is threaded into the internally threaded section to secure the shade mount in the holder of the existing boat structure.

2. The shade mount as set forth in claim 1, wherein a cross member in the holder is positioned in the gap between the at least two spaced apart sections when the second end of the shade mount is inserted into the holder.

3. The shade mount as set forth in claim 2, where the locking screw engages the cross member as the locking screw is threaded into the internally threaded section to secure the shade mount in the holder of the existing boat structure.

4. The shade mount as set forth in claim 1, wherein the first end is moveable with respect to the second end.

5. A retractable shade system for attachment to holder on an boat structure comprising:

a retractable shade a housing including:

a pair of telescoping arms;

a retractable cover positioned between the telescoping arm and movable between a furled position and an unfurled position;

a shade mount connectable to the retractable shade, the shade mount including;

a first end;

a second end positioned though the rod holder; where the second end include a internally thread section;

a locking screw threadable into the internally threaded section of the second end, where the locking screw can secure the shade mount in the rod holder.

6. The retractable shade system as set forth in claim 5, wherein the retractable cover is in the furled position, the retractable cover is positioned in the housing.

7. The retractable shade system as set forth in claim 5, wherein when the retractable cover is in the unfurled position, the retractable cover extends between and along the length of the telescoping swing arms.

8. The retractable shade system as set forth in claim 5, wherein a first end of the shade mount is removable connected to the housing of the retractable shade.

9. The retractable shade system as set forth in claim 5, wherein the second end of the shade mount is positionable in the holder in the existing boat structure.

10. The retractable shade system as set forth in claim 9, wherein the locking screw is threaded into the internally threaded section to secure the shade mount in the holder of the existing boat structure.

11. The retractable shade system as set forth in claim 10, wherein the at least two spaced apart sections expand as the locking screw is threaded into the internally threaded section to secure the shade mount in the holder of the existing boat structure.

12. The retractable shade system as set forth in claim 10, wherein a cross member in the holder is positioned in the gap between the at least two spaced apart sections when the second end of the shade mount is inserted into the holder.

13. The retractable shade system as set forth in claim 12, where the locking screw engages the cross member as the locking screw is threaded into the internally threaded section to secure the shade mount in the holder of the existing boat structure.

* * * * *